US005132883A

United States Patent [19]

La Lumandier

[11] Patent Number: 5,132,883

[45] Date of Patent: Jul. 21, 1992

[54] ILLUMINATED RAILING FOR SKATEBOARDS AND THE LIKE

[76] Inventor: Monroe A. La Lumandier, 825 Saratoga Heights, Harvester, Mo. 63303

[21] Appl. No.: 730,053

[22] Filed: Jul. 15, 1991

[51] Int. Cl.[5] ..... B60Q 1/24

[52] U.S. Cl. ..... 362/81; 362/82; 362/249; 362/253; 362/806; 280/87.042

[58] Field of Search ..... 362/81, 82, 253, 249, 362/251, 248, 806, 72, 61; 280/87.042, 11.19, 809, 816

[56] References Cited

U.S. PATENT DOCUMENTS 4,367,515 1/1983 Beard ..... 362/103
4,907,135 3/1990 Tarrson et al. ..... 362/206
4,991,066 2/1991 McCowan ..... 362/61
4,997,196 3/1991 Wood ..... 362/61

*Primary Examiner*—Ira S. Lazarus
*Assistant Examiner*—Sue Hagarman
*Attorney, Agent, or Firm*—Grace J. Fishel

[57] ABSTRACT

An illuminated railing for attachment to a skateboard as a bumper for protecting the bottom of the board or the ends thereof or the like. The railing is formed from a bar with externally viewable lights. The lights are connected to a circuit which includes a battery and a way to break the circuit. For use as a replacement part, the bar is preferably flexible and symmetrical to minimize the number of parts which must be stocked.

7 Claims, 1 Drawing Sheet

ILLUMINATED RAILING FOR SKATEBOARDS AND THE LIKE

The present invention relates to an illuminated railing for use as a protective bumper on the bottom of a skateboard.

BACKGROUND OF THE INVENTION

Skateboards are frequently given hard use by their owners. A pair of protective bumpers are usually provided along the side edges of the board to protect the bottom of the board from damage when it is run down a hand rail or the like. The bumpers on the side edges are usually curved to serve as a guide when the skateboard is slid along a curb to prevent it from snagging. In addition to protecting the board and serving as a guide, the bumpers on the side edges also provide a grip for picking it up. Front and rear bumpers are provided for protecting the tips of the skateboard and for use as a brake for stopping the skateboard when it is tipped up so that the rear end drags. Conventional bumpers have no other important functions and are not particularly decorative.

SUMMARY OF THE INVENTION

An illuminated railing in accordance with the present invention is provided for use as a protective bumper on the bottom side edges and ends of a skateboard. The illuminated railing has one or more externally viewable lights. The lights are connected in an electrical circuit with one or more batteries and with a control unit with a means for breaking the circuit. When the railing is used as a replacement part, it is preferably flexible enough to conform to the curvature of the specific bumper being replaced.

An important object of the present invention is to provide an illuminated railing for use as a protective bumper for the side edges and ends of a skateboard with aesthetic, safety and warning functions in addition to the usual functions of a bumper.

Other objects and features will be in part apparent and in part pointed out hereinafter.

BRIEF DESCRIPTION OF THE DRAWINGS

In the accompanying drawings, in which one of various possible embodiments of the invention is illustrated, corresponding reference characters refer to corresponding parts throughout the several views of the drawings and in which.

DETAILED DESCRIPTION OF THE INVENTION

Figure 1:
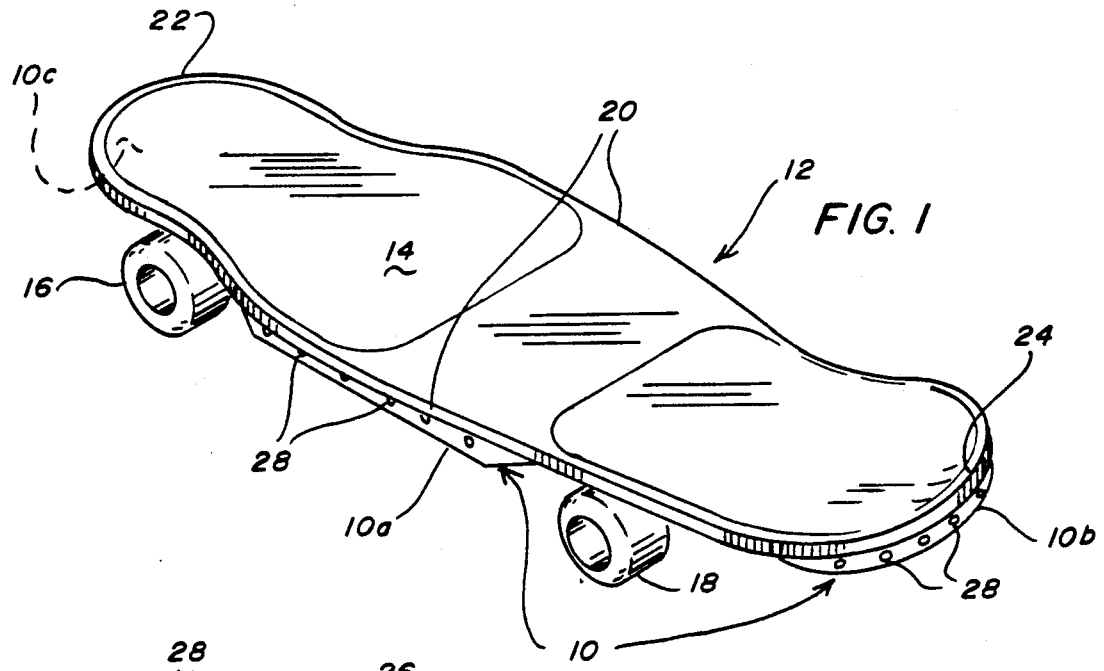
FIG. 1 is a rear perspective view of a skateboard shown with an illuminated side and rear railing in accordance with the present invention.

Referring to the drawings more particularly by reference number, illuminated railings 10 in accordance with the present invention are shown in FIG. 1 installed on a skateboard 12. Skateboard 12 includes a platform 14 mounted on pairs of front and rear wheels 16, 18 respectively. Skateboard 12 is of the kind to which protective bumpers can be attached to the bottom of platform 14 along its side edges 20 and to which front and rear protective bumpers can be attached to its front and rear ends 22, 24, respectively. The bumpers along side edges 20 are typically curved inwardly as viewed from the side to prevent the skateboard from snagging when it is slid along a curb or the like.

Illuminated railings 10 are a replacement (as original equipment or retroactively) for one or more of the bumpers normally found on a skateboard (whether or not the particular skateboard has bumpers as original equipment). With continuing reference to FIG. 1, railing **10*a* is a replacement for the bumpers along side edges 20 and railing 10*b* is a replacement for the bumper at rear end 24. A third railing 10*c* is a replacement for the bumper at front end 22. While all of the bumpers have been replaced with illuminated railings 10 in FIG. 1, it will be appreciated that the benefits of the present invention can be enjoyed, for example, by just replacing the bumpers on side edges 20**.

Figure 2:
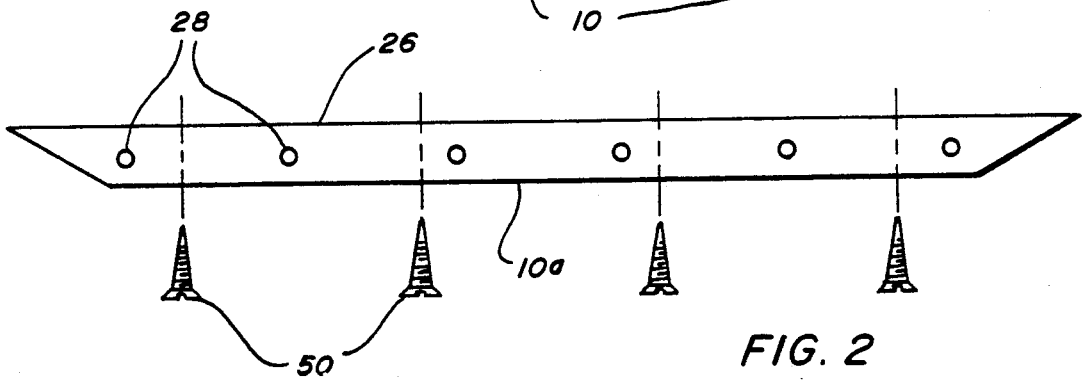
FIG. 2 is a side elevation of the side railing shown in FIG. 1 as viewed from the outside with the screws by which it is attached exploded away.
Figure 3:
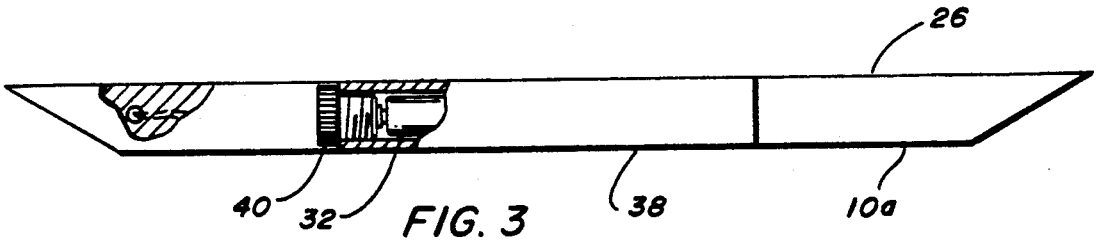
FIG. 3 is a side elevation of the side railing shown in FIG. 1 as viewed from the inside, partially broken away to show a battery in a battery case and a light; and, FIG. 4 is a top plan view of the side railing shown in FIG. 1 with a cap for the battery case removed and with an electrical circuit for the lights shown in dotted lines, in other dotted lines the side railing is shown flexed to conform to the curvature of the bumper which is being replaced.
Figure 4:
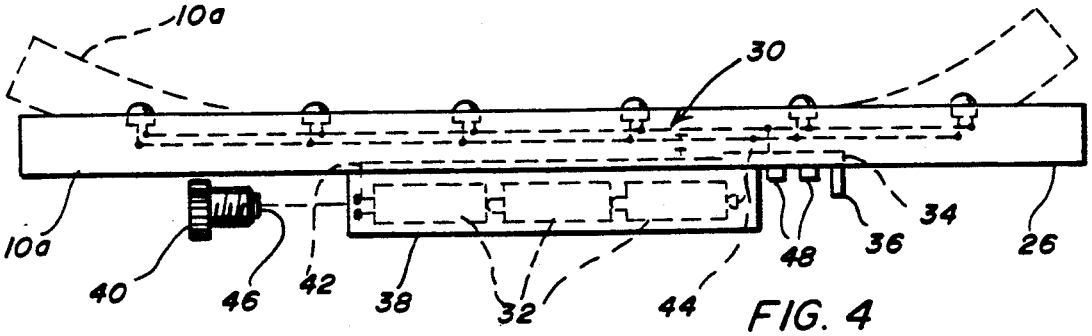

FIGS. 2–4 show details of railing **10*a* but the same details generally apply to railings 10*b* and 10*c*. With continuing reference to FIGS. 2–4, railings 10*a* are formed of a bar 26 attached horizontally to the bottom of skateboard 12 to serve as a guard. The curvature of the bumpers along side edges 20 differ among models so that bar 26 must be formed in the right shape when it is manufactured or made flexible enough so that it can be bent into the right shape by the user. To avoid stocking a large number of different railings 10*a*, for example, bar 26 is preferably formed as a straight piece from a material, such as a plastic material, which is resistant to abrasion and which is sufficiently flexible that it can conform to the curvature of the specific bumper being replaced. In addition, railings 10*a*** are preferably symmetrical about their midpoint such that the right and left railings are identical and different railings are not required.

The side bumpers are usually attached with four screws. Comparable generalities apply to the front and rear bumpers.

Illuminated railings **10*a* in accordance with the present invention preferably conform to standardized assembly practices with respect to fastener placement for ease of attachment as more particularly described below although they could be made in other sizes if this feature is sacrificed. Railings 10*a* are preferably about $\frac{7}{8}$ inch thick and $\frac{3}{4}$ inch wide. Both dimensions are slightly more than standard to allow for attachment of a battery case and to provide a wear buffer for a circuit housed in bar 26** as described below.

One or more externally viewable lights 28 are provided on bar 26. Lights 28 can be light emitting diodes (LED), gaseous strobes, electric light bulbs behind a light transmitting sheet or panel or the like. In some embodiments, bar 26 can be transparent or translucent and lights 28 can be used to illuminate the length of the bar, for example. Lights 28 can also be of a display type using multi-pixel or character segments such that railings 10 can display a personal or advertising message and so forth. Lights 28 can face in any direction, i. e., up or down, as well as out to the side. Such alternate arrangements are of particular benefit to transparent boards or during a performance on ramps or during acrobatic feats. In the embodiment illustrated in FIGS. 2–4, lights 28 are embedded below the outer surface of bar 26 such that they do not stick out where they could be broken. They are preferably arranged in an orderly fashion along the entire length of bar 26. Lights 28 may be colored and are connected in an electric circuit 30 that includes one or more batteries 32 and a control unit 34 with a means for breaking the circuit 30.

As shown in FIGS. 3 and 4, batteries 32 are housed in a battery case 38 attached to the inside of bar 26 (as viewed from side 20 when installed on skateboard 12). A plurality of batteries 32 (such as three "AA" batteries) are shown in battery case 38 which is closed with a screw cap 40 or the like. It will be appreciated that the particular battery case, its location and the particular cap are for illustration purposes only and that other constructions and arrangements will occur to those skilled in the art and are part of the present invention.

Batteries 32 are connected by leads 42 and 44 to control unit 34. In a simple form, cap 40 includes a metal strip 46 which serves as means 36 for breaking the circuit. In this instance, lead 42 is connected to cap 40 and control unit 34 is not a separate component. In other instances, as illustrated, means 36 for breaking the circuit is a switch provided on the inside of bar 26 (as viewed from the side edge 20 when installed on skateboard 12). Lights 28 can be self-flashing lamps or LEDS. For other flashing patterns, control unit 34 may include, for example, a simple electronic counter circuit. It may also include a preselected program (or plurality of such programs) for flashing lights 28. A means 48 (illustrated as push buttons) can be provided for selectively actuating the program(s). For example, control unit 34 can include a program for flashing lights 28 asynchronously, a program for flashing them synchronously, a program for flashing them sequentially and so forth. The programs can be provided as a ROM in control unit 34 or control unit 34 can be programmable by the user.

In use as a replacement part, the bumpers to be replaced are removed by removing screws 50 which usually attach them to the bottom of platform !4. The same screws 50 (shown in FIG. 2) are used to attach illuminated railing 10 to the bottom of platform 14. To make use of the same screw holes in the bottom of platform 14, railing 10 is preferably flexible and bent as it is installed to conform to the curvature of the bumper being replaced. In use as original equipment or for use as a replacement part on a particular model of skateboard, railing 10 need not be flexible since it can be formed in the right shape for attachment.

Once illuminated railing 10 is installed, whether as a replacement part or as original equipment, it serves the same function as an ordinary bumper. In addition, lights 28 make railing 10 aesthetically more satisfying and the skateboard 12 more visible which serves safety and warning functions.

In view of the above, it will be seen that the objects of the invention are achieved and other advantageous results attained. As various changes could be made in the above constructions without departing from the scope of the invention, it is intended that all matter contained in the above description or shown in the accompanying drawings shall be interpreted as illustrative and not in a limiting sense.

What is claimed:

1. An illuminated skid for attachment to a skateboard or the like, said skateboard having a platform upon which a user rides with a bottom, sides and ends, said skid being a unitary construction symmetrical about its transverse axis comprising a bar which is attachable to the underside of the platform adjacent the sides for protecting the bottom thereof, said bar having one or more externally viewable recessed lights connected in an electric circuit with a battery and a control unit that has a means for breaking the circuit.

2. The illuminated skid of claim 1 wherein the battery is contained in a case unitary with the bar, said case closed with a cap and wherein the means for breaking the circuit is an electric contact in the cap for completing the circuit so that circuit is broken by movements of the cap.

3. The illuminated skid of claim 1 for use as a replacement for an existing skid wherein the bar is formed of a flexible material such that the skid can be conformed to the curvature of the skid being replaced.

4. The illuminated skid of claim 1 wherein there are a plurality of lights and the lights are arranged in an orderly fashion along the skid.

5. The illuminated skid of claim 1 wherein the control unit further includes a preselected program for flashing the lights and a means for selectively actuating said program.

6. The illuminated skid of claim 5 wherein the lights are LEDs.

7. The illuminated skid of claim 5 wherein the lights are display type using multi-pixel or character segments such that the illuminated skid can display a personal or advertising message.

* * * * *